United States Patent [19]

Yamaguchi et al.

[11] Patent Number: 5,036,743

[45] Date of Patent: Aug. 6, 1991

[54] KEYBOARD DEVICE FOR ELECTRONIC MUSICAL INSTRUMENT

[75] Inventors: Tsutomu Yamaguchi, Kakegawa; Norizou Kamimura, Tokorozawa; Yutaka Tamai; Yoshiaki Shimoda, both of Hamamatsu, all of Japan

[73] Assignee: Kabushiki Kaisha Kawai Gakki Seisakusho, Hamamatsu, Japan

[21] Appl. No.: 442,616

[22] Filed: Nov. 29, 1989

[30] Foreign Application Priority Data

Nov. 30, 1988 [JP] Japan ..... 63-303688

[51] Int. Cl.[5] ..... G10C 3/12

[52] U.S. Cl. ..... 84/434

[58] Field of Search ..... 84/433–435, 84/236–240

[56] References Cited

U.S. PATENT DOCUMENTS 4,896,577 1/1990 Trivelas et al. ..... 84/240

4,901,614 2/1990 Kumano et al. ..... 84/433 X

FOREIGN PATENT DOCUMENTS 263494 4/1988 European Pat. Off. .

*Primary Examiner*—Brian W. Brown

*Attorney, Agent, or Firm*—Michael N. Meller

[57] ABSTRACT

A keyboard device has a key, a support for the key, the key being rotatably mounted on the key support, a hammer, a support for the hammer, the hammer being rotatably mounted on the hammer support, a resilient member for urging the key to swing in a direction which is the same as the direction of swinging of the key when the key is depressed and for urging the hammer to swing in a direction which is opposite to the direction of swinging of the hammer when the key is depressed. The resilient member has a first end coupled to the key and a second end coupled to the hammer.

3 Claims, 3 Drawing Sheets

KEYBOARD DEVICE FOR ELECTRONIC MUSICAL INSTRUMENT

FIELD OF THE INVENTION

The invention relates to a keyboard device for an electronic musical instrument such as an electronic piano or an electronic organ.

BACKGROUND OF THE INVENTION

A conventional keyboard device for an electronic musical instrument is shown in FIG. 9. That keyboard device comprises a key b supported at its rear end for swinging movement about a shaft a mounted on a keyboard chassis, a hammer c disposed for swinging movement about a shaft a' so that it may be operated in association with key b during depression of the key, and a resilient member d resiliently engaged with key b at one end and with hammer c at the other end thereof and arranged to urge key b and hammer c respectively against the corresponding shafts.

The resilient member d of the keyboard device biases key b and hammer c in a swinging direction opposite to a direction of swinging movement occurring during depression of the key, i.e., in a returning direction.

The conventional keyboard device of FIG. 9 is disadvantageous in that the load characteristic, particularly the initial load on the key b, may be influenced by a dispersion in characteristic of the resilient member d, and in that it is difficult to provide a desired performance.

BRIEF SUMMARY OF THE INVENTION

The object of the present invention is to overcome the above-discussed problem with the prior art.

To achieve that object, the present invention provides a keyboard device for an electronic musical instrument comprising a key swingably supported with its rear end engaging a shaft mounted on a keyboard chassis, a hammer swingably disposed in engagement with a shaft mounted on the keyboard chassis so that it may be operated in association with the key during depression of the key, and a resilient member resiliently engaged at its opposite ends respectively with the key and the hammer to urge the key and the hammer against the shafts respectively, wherein the engaged positions of the resilient member on the key and the hammer are so set as to reduce the load exerted on the key by the resilient member to nearly zero by causing the resilient member to act on the hammer and the key to swing the hammer always in a returning direction and to swing the key always in the same swinging direction as during depression of the key, whereby the key is made to return by the swinging movement in the returning direction of the hammer by its own weight.

As a result of the structure of the keyboard device according to the present invention, even if there is a dispersion in characteristic of the resilient member for returning the key, the load characteristic, particularly the initial load on the key, cannot be influenced by such dispersion, and a desired characteristic can be easily provided.

BRIEF DESCRIPTION OF THE DRAWINGS

The preferred embodiment of the present invention will now be described with reference to the accompanying drawings, wherein.

DETAILED DESCRIPTION OF THE PREFERRED EMBODIMENT

Figure 1:
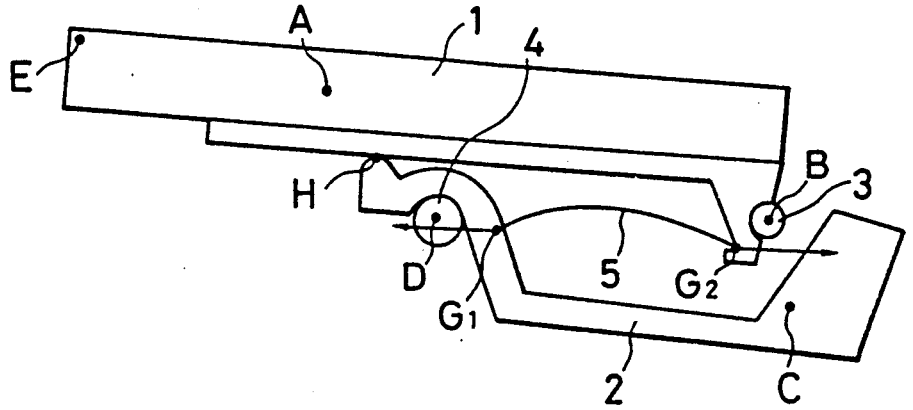
FIGS. 1 to 4 are diagrams which illustrate the principle of the present invention.

In FIG. 1, a key 1 is swingably supported on a shaft 3, and a hammer 2 is swingably supported on a shaft 4. A resilient member 5, such as a leaf spring, is mounted between key 1 and hammer 2 to urge them against shafts 3 and 4, respectively. The resilient member 5 exerts a force on hammer 2 and key 1 to swing hammer 2 always in a returning direction and to swing key 1 always in the same swinging direction as that produced by depression of the key.

Figure 2:
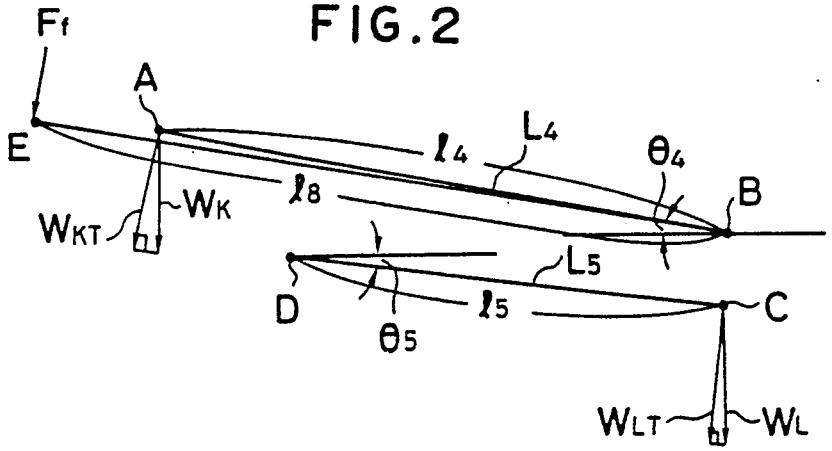

In FIG. 1, A denotes a center of gravity of key 1; B denotes a fulcrum of key 1; C denotes a center of gravity of hammer 2; D denotes a fulcrum of hammer 2; E denotes a point of loading on key 1; G1 and G2 denote points of engagement of resilient member 5 with hammer 2 and key 1, respectively; and H denotes a contact point of key 1 with hammer 2. As shown in FIG. 2, if the weight $W_K$ of key 1 is applied to the center of gravity A and the weight $W_L$ of hammer 2 is applied to the center of gravity C, and if an angle between a line $L_4$ connecting the center of gravity A of key 1 and the fulcrum B and a horizontal line is denoted by $\theta_4$, and an angle between a line $L_5$ connecting the center of gravity C of hammer 2 and the fulcrum D and the horizontal line is denoted by $\theta_5$, a force component $W_{KT}$ perpendicular to line $L_4$ of weight $W_K$ and a force component $W_{LT}$ perpendicular to line $L_5$ of weight $W_L$ are given by the following equations:

$$W_{KT}=W_K \cos \theta_4 \quad (1)$$

$$W_{LT}=W_L \cos \theta_5 \quad (2)$$

Figure 3:
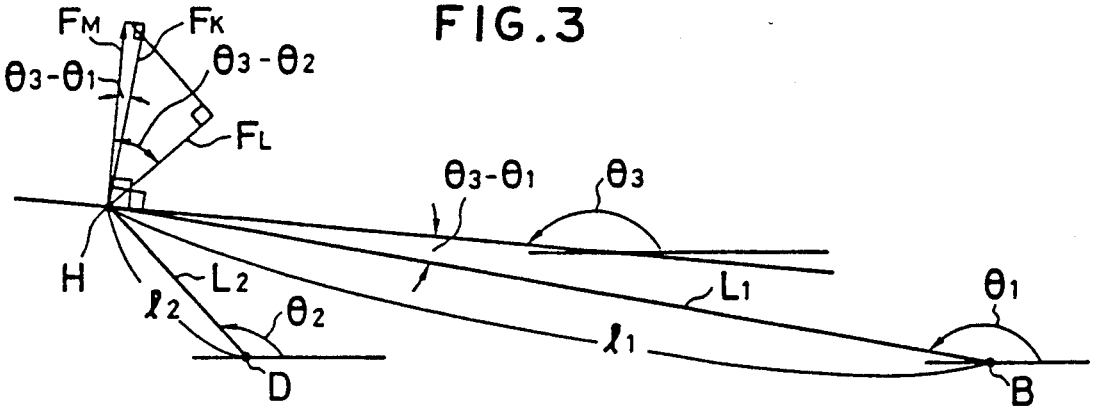

In FIG. 3, if an angle between a line $L_1$ connecting the contact point H and the fulcrum B and the horizontal line is denoted by $\theta_1$; an angle between a line $L_2$ connecting the contact point H and the fulcrum D and the horizontal line is denoted by $\theta_2$; an angle between a contact surface of key 1 with hammer 2 and the horizontal line is denoted by $\theta_3$; a force of hammer 2 vertically acting on the contact surface of key 1 and hammer 2 is denoted by $F_M$; a component of force $F_M$ perpendicular to line $L_2$ is denoted by $F_L$; and a component of force $F_M$ perpendicular to line $L_1$ is denoted by $F_K$, the following relations are established.

$$F_M = \frac{F_L}{\cos(\theta_3 - \theta_2)} \quad (3)$$

$$F_K = F_M \cos(\theta_3 - \theta_1) \quad (4)$$

Accordingly, the following relation is established:

$$F_K = \frac{\cos(\theta_3 - \theta_1)}{\cos(\theta_3 - \theta_2)} F_L \quad (5)$$

Figure 4:
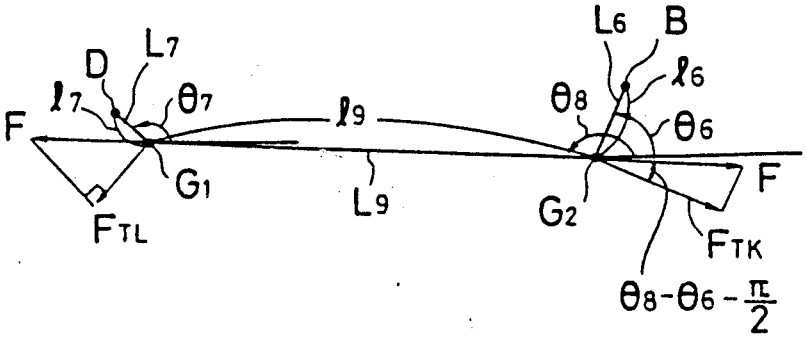

In FIG. 4, if a line connecting the points of engagement $G_1$ and $G_2$ is denoted by $L_9$; a line connecting the point of engagement $G_1$ and the fulcrum D is denoted by $L_7$; a line connecting the point of engagement $G_2$ and the fulcrum B is denoted by $L_6$; a force of resilient member 5 is denoted by F; a component of force F perpendicular to line $L_7$ is denoted by $F_{TL}$; a component of force F perpendicular to line $L_6$ is denoted by $F_{TK}$; an angle formed by line $L_6$ and the horizontal line is denoted by $\theta_6$; an angle formed by line $L_7$ and the horizontal line is denoted by $\theta_7$; and an angle formed by line $L_9$ and the horizontal line is denoted by $\theta_8$, the following equations are established:

$$F_{TK} = F \cdot \cos(\theta_8 - \theta_6 - \pi/2) \quad (6)$$

$$F_{TL} = F \cdot \cos\{\pi/2 - (\theta_8 - \theta_7)\} \quad (7)$$

The equations for the balance of forces on the system of key 1 and hammer 2 derived from the above equations are as follows:

$$F_f \cdot l_8 + W_{KT} \cdot l_4 + F_{TK} \cdot l_6 = F_K \cdot l_1 \quad (8)$$

$$F_L \cdot l_2 = F_{TL} \cdot l_7 + W_{LT} \cdot l_5 \quad (9)$$

wherein $l_8$, $l_4$, $l_6$, $l_1$, $l_2$, $l_7$ and $l_5$ are lengths of the line $L_8$, $L_4$, $L_6$, $L_1$, $L_2$, $L_7$ and $L_5$ respectively, and $F_f$ is a load acting on the leading end of key 1. From equations (8) and (9), the following equation is established:

$$F_f = \frac{1}{l_8}\left[\frac{l_1}{l_2} \cdot \frac{\cos(\theta_3 - \theta_1)}{\cos(\theta_3 - \theta_2)} \cdot \{F \cdot l_7 \cdot \cos(\pi/2 - \theta_8 + \theta_7) + W_L \cdot l_5 \cdot \cos\theta_5\} - W_K \cdot l_4 \cdot \cos\theta_4 - F \cdot l_6 \cdot \cos(\theta_8 - \theta_6 - \pi/2)\right] \quad (10)$$

In addition, if the weights of key 1 and hammer 2 are ignored, the following equation is established:

$$F_f' = \frac{1}{l_8}\left[\frac{l_1}{l_2} \cdot \frac{\cos(\theta_3 - \theta_1)}{\cos(\theta_3 - \theta_2)} \cdot \{F \cdot l_7 \cdot \cos(\pi/2 - \theta_8 + \theta_7)\} - F \cdot l_6 \cdot \cos(\theta_8 - \theta_6 - \pi/2)\right] \quad (11)$$

Figure 5:
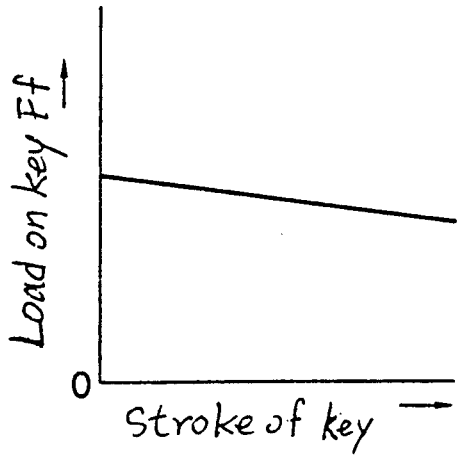
FIGS. 5 and 6 are graphical depictions of the equations for the load acting on the leading end of the key, with the weights of the key and hammer considered and not considered, respectively.
Figure 6:
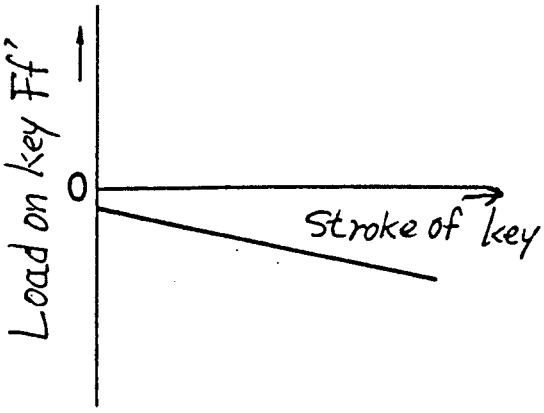

If actual numerical values are introduced into equations (10) and (11), the values $F_f$ and $F_f'$ are as shown in FIGS. 5 and 6, respectively.

When the weights of key 1 and hammer 2 are ignored, the load $F_f'$ exerted on key 1 by resilient member 5 is always negative, as shown in FIG. 6, and can be lowered to almost zero by proper selection of the positions of engagement of resilient member 5 with key 1 and hammer 2. Thus, if this is done, only a small dispersion in resilient force of resilient member 5 is produced during initial loading on key 1 and hence, the load on key 1 may be determined by the weights of key 1 and hammer 2.

Figure 8:
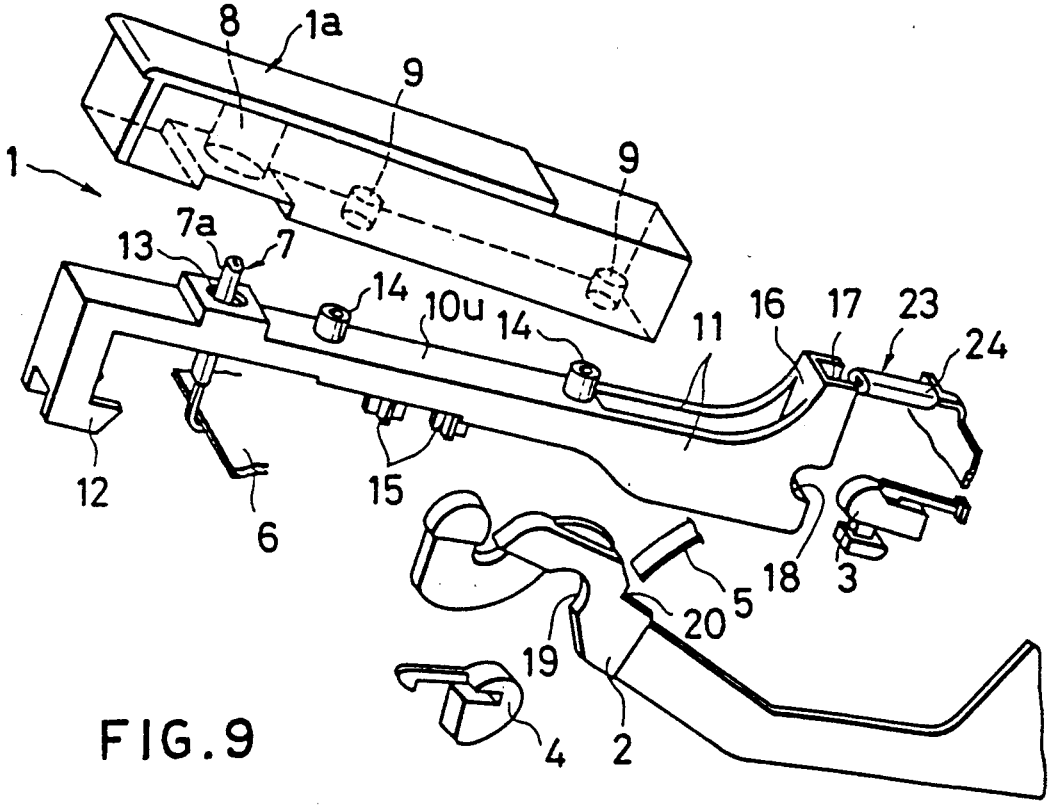
FIG. 8 is an exploded perspective view of an essential portion of the embodiment of FIG. 7.
Figure 9:
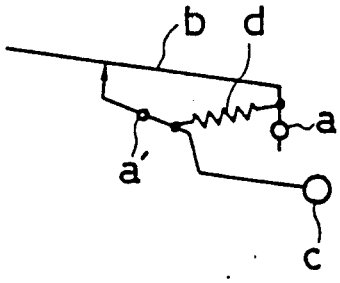
FIG. 9 illustrates a principle of the prior art.
Figure 7:
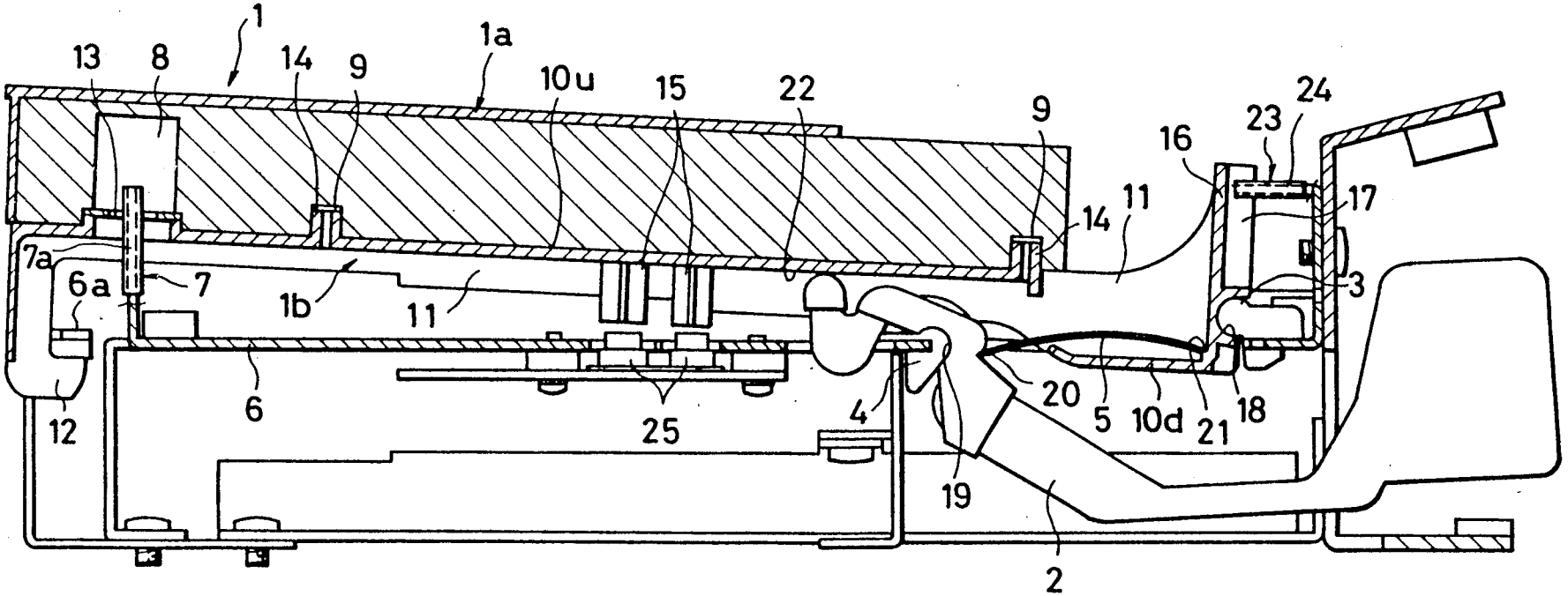
FIG. 7 is a side view, partly in section, of one embodiment of the present invention.

Referring to FIGS. 7 and 8, key 1 comprises a a wood key member 1*a* and a synthetic resin key member 1*b* coupled to the lower surface of wood key member 1*a* with its leading end aligned with a leading end of wood key member 1*a*. The lower surface of wood key member 1*a* is provided with a hole 8 into which a lateral-deflection blocking pin 7 (which will be described hereinafter) is fitted, and recesses 9 for coupling wood key member 1*a* and synthetic resin key member 1*b*. Synthetic resin key member 1*b* has the same width as wood key member 1*a* and a length greater than that of wood key member 1*a*, and its portion overlapping wood key member 1*a* is formed into an inverted U-shaped section by a top wall 10*u* and opposing sidewalls 11. Synthetic resin key member 1*b* has, at its leading end, a stopper 12 engaging a stopper 6*a* mounted on a keyboard chassis 6 and is provided at the top wall 10*u* with hole 13 into which lateral-deflection blocking pin 7 is fitted. Key member 1*b* is also provided at its upper surface with projections 14 for engagement with recesses 9 of key member 1*a* and at its lower surface, for example, with a pair of switch depressing projections 15. A portion of key member 1*b* projecting from a rear end of key member 1*a* is formed into a U-shaped section by opposing sidewalls 11 and a bottom wall 10*d* connecting the sidewalls, and includes, at its rear end, an end wall 16 connected to end edges of the opposing sidewalls 11 and an end edge of bottom wall 10*d*. A groove 17 is provided in an outer surface of end wall 16, and a recess 18 is provided at a lower end of that outer surface. Recess 18 is an engagement portion which engages shaft 3, which is mounted on keyboard chassis 6 to swingably support key 1. Thus, key 1 is swingably supported at its rear end on keyboard chassis 6 by the fitting of recess 18 of end wall 16 over the shaft 3.

Hammer 2 is intended to provide, even in an electronic musical instrument, the same key touch feeling as in a piano and is swingable due to a recess 19 provided at a lower portion in the vicinity of its front end being fitted over a shaft 4 mounted on keyboard chassis 6. A resilient member 5 is mounted in a bent manner to extend between an engaging recess 20 on an upper surface of hammer 2 in the vicinity of the front end thereof and an engaging recess 21 of key 1, so that key 1 and hammer 2 are urged against shafts 3 and 4 respectively by a resilient force of resilient member 5. The engaged positions of resilient member 5 to key 1 and hammer 2 are set so that resilient member 5 acts on hammer 2 and key 1 to always swing hammer 2 in a returning direction and to always swing key 1 in the swinging direction produced by depression of the key, so that a load exerted on key 1 by resilient member 5 may be approximately zero. Thus, key 1 is adapted to be urged upwardly and returned to an original position upon swinging movement of hammer 2 by its own weight in the returning direction. In addition, hammer 2 is adapted to be urged and swung by a lower surface 22 of top wall 10*u*, i.e., a contact surface 22 of key 1 with hammer 2 during depression of the key.

In FIGS. 7 and 8, reference numeral 23 denotes a deformable guide pin covered with a cover made of a flexible material, e.g., a plastic cover 24. Guide pin 23 has its base portion attached to keyboard chassis 6 and its leading end loosely fitted in groove 17 provided on the outer surface of end wall 16, so that changing of the direction of guide pin 23 causes key 1 to swing laterally, whereby the lateral inclination of key 1 is corrected. The lateral-deflection blocking pin 7 is formed to rise from an end face of keyboard chassis 6 and has a plastic cover *7a* fitted over its outer periphery. Pin 7 is fitted in holes 8 and 13 in key 1. Reference numeral 25 denotes a key switch attached to keyboard chassis 6.

The foregoing description of the preferred embodiment of the invention is given for the purpose of illustration only. Structural modifications within the scope and spirit of the claimed invention will be obvious to one of ordinary skill in the art.

We claim:

1. A keyboard device for an electronic musical instrument comprising a key swingably supported at a rear end thereof by engagement with a first shaft mounted on a keyboard chassis, a hammer swingably supported at a portion thereof by engagement with a second shaft mounted on said keyboard chassis so that said hammer may be operated in association with said key during depression of said key, and a resilient member having opposing ends which resiliently engage respectively with said key and said hammer to urge said key and said hammer against said first and second shafts respectively, wherein a point of contact of said key and said hammer is located such that said hammer swings in a direction which is the same as a direction of rotation of said key in response to depression of said key and positions of engagement of said resilient member with said key and said hammer are set so that a force exerted on said hammer in a direction opposite to said direction of rotation of said key produced by depression of said key and a force exerted on said key in the direction of rotation of said key produced by depression of said key are kept in balance by causing said resilient member to urge said hammer to swing in a direction opposite to said direction of rotation of said key produced by depression of said key and to urge said key to swing in said direction of rotation of said key produced by depression of said key, whereby upon release of said key, said key is urged at said point of contact to swing in said opposite direction in response to swinging of said hammer in said opposite direction under a force of the weight of said hammer.

2. The keyboard device as defined in claim 1, wherein centers of gravity of the key and hammer are on opposite sides of a pivot point of said hammer.

3. A keyboard device comprising: a key, means for supporting said key, said key being rotatably mounted on said key supporting means, a hammer, means for supporting said hammer, said hammer being rotatably mounted on said hammer supporting means, means for urging said key to swing in a direction which is the same as a direction of swinging of said key when said key is depressed and means for urging said hammer to swing in a direction which is opposite to a direction of swinging of said hammer when said key is depressed, wherein said means for urging said key and said means for urging said hammer respectively comprise first and second ends of a common resilient member, said first end being coupled to said key and said second end being coupled to said hammer.

* * * * *